US007829851B2

(12) United States Patent
McLuckey et al.

(10) Patent No.: US 7,829,851 B2
(45) Date of Patent: Nov. 9, 2010

(54) METHOD AND APPARATUS FOR COLLISIONAL ACTIVATION OF POLYPEPTIDE IONS

(75) Inventors: Scott A. McLuckey, West Lafayette, IN (US); Hongling Han, West Lafayette, IN (US); Yu Xia, West Lafayette, IN (US)

(73) Assignee: Purdue Research Foundation, West Lafayette, IN (US)

( * ) Notice: Subject to any disclaimer, the term of this patent is extended or adjusted under 35 U.S.C. 154(b) by 311 days.

(21) Appl. No.: 11/998,266

(22) Filed: Nov. 29, 2007

(65) Prior Publication Data

US 2008/0128610 A1 Jun. 5, 2008

Related U.S. Application Data

(60) Provisional application No. 60/872,357, filed on Dec. 1, 2006.

(51) Int. Cl.
*H01J 1/42* (2006.01)

(52) U.S. Cl. ..... 250/292; 250/282; 250/290

(58) Field of Classification Search ..... 250/283, 250/281, 292, 285, 282, 288
See application file for complete search history.

(56) References Cited

U.S. PATENT DOCUMENTS 6,483,109 B1 11/2002 Reinhold et al.
6,566,651 B2 * 5/2003 Baba et al. ..... 250/281
6,720,554 B2 4/2004 Hager
6,797,949 B2 9/2004 Hashimoto et al.
7,060,972 B2 6/2006 Hager
7,227,130 B2 * 6/2007 Hager et al. ..... 250/282
7,361,888 B1 * 4/2008 Boyle et al. ..... 250/285
7,365,319 B2 * 4/2008 Hager et al. ..... 250/292

(Continued)

FOREIGN PATENT DOCUMENTS

EP 1 339 088 A2 8/2003

(Continued)

OTHER PUBLICATIONS

Syka, John, E.P., et al., "Peptide and protein sequence analysis by electron transfer dissociation mass spectrometry," Proc. Nat. Acad. Sci. U.S.A., 2004, 101, 9528-9533, pp. 1-7.

(Continued)

*Primary Examiner*—Jack I Berman
*Assistant Examiner*—Johnnie L Smith
(74) *Attorney, Agent, or Firm*—Brinks Hofer Gilson & Lione

(57) ABSTRACT

A method and apparatus for identification of activating ions by collisions is described. The method uses a plurality of linear ion taps and a plurality of sources of ions and a mass measuring device. A first source is operated to dispense first ions into first trap, where the ions may be kinetically cooled. A second source is operated to dispense second ions into the first trap, where the first and the second ions are stored. Ions in the first trap are ejected so as to enter a second trap, where the ions are stored prior to mass spectrometry. The apparatus may use quadrupole rods to form the ion traps, and the voltage and pressure differences between the first and second traps are controllable values.

20 Claims, 4 Drawing Sheets

U.S. PATENT DOCUMENTS

| | | | | |
|---|---|---|---|---|
| 7,456,397 | B2 * | 11/2008 | Hartmer et al. | 250/292 |
| 2003/0052264 | A1 * | 3/2003 | Baba et al. | 250/281 |
| 2004/0183005 | A1 * | 9/2004 | Hager | 250/282 |
| 2005/0199804 | A1 * | 9/2005 | Hunt et al. | 250/290 |
| 2005/0263697 | A1 * | 12/2005 | Hager et al. | 250/292 |
| 2006/0255261 | A1 * | 11/2006 | Whitehouse et al. | 250/288 |
| 2007/0018094 | A1 * | 1/2007 | Hager et al. | 250/292 |
| 2007/0045531 | A1 * | 3/2007 | Mordehai et al. | 250/285 |
| 2007/0069124 | A1 | 3/2007 | Baba et al. | |
| 2008/0067342 | A1 | 3/2008 | Ding | |
| 2008/0073498 | A1 * | 3/2008 | Kovtoun | 250/282 |
| 2008/0128610 | A1 * | 6/2008 | McLuckey et al. | 250/283 |
| 2008/0128611 | A1 * | 6/2008 | McLuckey et al. | 250/283 |
| 2008/0203288 | A1 * | 8/2008 | Makarov et al. | 250/282 |
| 2008/0245963 | A1 * | 10/2008 | Land et al. | 250/288 |

FOREIGN PATENT DOCUMENTS

| | | |
|---|---|---|
| WO | WO 92/14259 | 8/1992 |
| WO | WO 2004/063702 A2 | 7/2004 |

OTHER PUBLICATIONS

International Search Report from PCT international application No. PCT/US2007/024616 dated Nov. 27, 2008 (4 pages).

Written Opinion of the International Searching Authority for International Application No. PCT/US2007/024616, dated Nov. 27, 2008, 8 pages.

International Search Report from PCT international application No. PCT/US2007/024613 dated Jan. 15, 2009 (3 pages).

International Search Report from PCT International Application No. PCT/US2008/087099 dated Jul. 20, 2009, 3 pages.

Written Opinion of the International Searching Authority for International Application No. PCT/US2008/087099, dated Jul. 20, 2009, 4 pages.

* cited by examiner

METHOD AND APPARATUS FOR COLLISIONAL ACTIVATION OF POLYPEPTIDE IONS

This application claims the benefit of U.S. provisional application Ser. No. 60/872,357, filed on Dec. 1, 2006, which is incorporated herein by reference.

TECHNICAL FIELD

This application may relate to a method and apparatus for identifying components of a biomolecule, and in particular to the identification of proteins.

BACKGROUND

The dissociation of gaseous polypeptide ions, in a tandem mass spectrometry experiment, plays a role in several commonly used approaches for the identification of proteins. The most commonly used approach for activating polypeptide ions has involved energetic collisions with neutral target gases, and is referred to as collisional activation.

A range of collisional activation conditions have been utilized that include collision energies ranging from a few electron volts to as high as several kilo-electron volts; numbers of collisions ranging from a single collision to many hundreds of collisions; and, time-scales ranging from the time for a single collision to hundreds of milliseconds. In general, collisional activation methods have been useful in deriving primary structure information from peptide and protein ions. However, no single dissociation method has able to provide all structural information of interest. For example, collisional activation often fails to provide complete primary structure information, and often fails to provide information regarding the positions of post-translational modifications.

Approaches other than energetic collisions with gaseous targets have been also examined for dissociating polypeptide ions. These include, for example, collisions with surfaces, referred to as surface-induced dissociation, and a range of photo-dissociation techniques, such as infra-red multi-photon dissociation (IRMPD), black-body infra-red dissociation (BIRD), and single-photon UV-photo-dissociation at one of several wavelengths. In the case of multiply-protonated polypeptides, ion-electron and ion-ion reactions have been used. Electron capture by, or electron transfer to, a multiply-protonated peptide gives rise to fragmentation that is often highly complementary to that resulting from collisional activation. The former is referred to as electron capture dissociation (ECD) and the latter is referred to as electron transfer dissociation (ETD). Both ECD and ETD have proven to be of particular utility for the characterization of post-translationally modified peptide and protein cations.

In the case of an ETD experiment, products from an ion/ion reaction can be allocated into one of three principal categories. These are proton transfer, a competing ion/ion reaction that generally does not lead to fragmentation; electron transfer followed directly by dissociation (i.e., the ETD process); and, electron transfer without subsequent dissociation of the polypeptide product. The partitioning between these three reaction categories is, at least to some extent, particular to each species of reactant ions. For example, the competition between proton transfer and electron transfer is known to depend strongly upon the identity of the reagent anion. The size and charge state of the peptide ion may play a significant role in determining the extent to which ETD occurs relative to electron transfer without dissociation, and the temperature of the bath gas in the electrodynamic ion trap used as a reaction vessel can affect the relative contributions of the total ETD, the relative contributions of individual reaction categories that contribute to ETD, and the extent of electron transfer without dissociation. Doubly-protonated peptides of the size often observed from tryptic digests, for example, usually show significantly less ETD than the triply charged versions of the same peptide.

From an analysis perspective, it may desirable to minimize the competitive proton transfer channel and to maximize ETD relative to electron transfer without dissociation. The selection of the reagent anion may be important in this regard. One technique that may maximize the extent of ETD for species that undergo electron transfer, but do not dissociate, is to subsequently activate these electron transfer products. That is, subsequent activation of the electron transfer (ET) "survivors" can improve the net conversion of precursor ions to structurally informative product ions.

In this regard, it may desirable to maximize the dissociation of the survivors while minimizing dissociation of proton transfer products. The latter species generally give rise to b-and y-type ions that could complicate spectral interpretation and may compromise the quality of data-base matching algorithms that assume the formation of only the c-and z-type ions generally associated with ETD. The use of elevated bath gas temperature is one technique of altering the extent of ETD. However, this approach can affect both the reactant ions and the product ions and, therefore, may not be exclusively an activation method for survivor ions.

The use of elevated bath gas temperatures, for example, has not been shown to consistently provide improved ETD yields relative to the use of room temperature bath gas.

SUMMARY

A method of mass spectrometry is disclosed, the method including creating a first ion trapping volume within a chamber of a first ion trap; injecting a first population of ions into the ion trapping volume so that the first population is stored in the trapping volume; injecting a second population of charged ions into the first ion trapping volume such that a physical overlap of the first and the second ion populations occurs; creating a second ion trapping volume within a chamber of a second ion trap; ejecting ions from the first ion trap into the second ion trap; and, performing mass spectrometry on the ions of the second ion trap.

In an aspect, a method of performing mass spectrometry includes: operating a first source of ions; selecting first ions by a mass filter and injecting the selected first ions into a first volume acting as first linear ion trap (LIT); switching off the first source and cooling the selected first ions in the first LIT; operating a second source of ions; selecting second ions by a mass filter and injecting the selected second ions into the first volume acting as a LIT; storing the first and second selected ions in the first LIT; ejecting stored ions from the first LIT to a second LIT; and, analyzing a mass of the ions of the second LIT.

An apparatus for analyzing molecules is disclosed including a first linear ion trap (LIT), configured to accept and store a first population of ions; and, to accept and store a second population of ions. A second linear ion trap (LIT) is configured to accept stored ions ejected from the first LIT by application of a voltage between the first and the second LITs; and, a mass analyzer for analyzing the ions of the second LIT.

DETAILED DESCRIPTION

Exemplary embodiments may be better understood with reference to the drawings, but these embodiments are not intended to be of a limiting nature. In the following description, numerous specific details are set forth in order to provide a thorough understanding of the present invention which, however, may be practiced without some or all of these specific details. In other instances, well known process operations have not been described in detail in order not to unnecessarily obscure the description.

Figure 1:
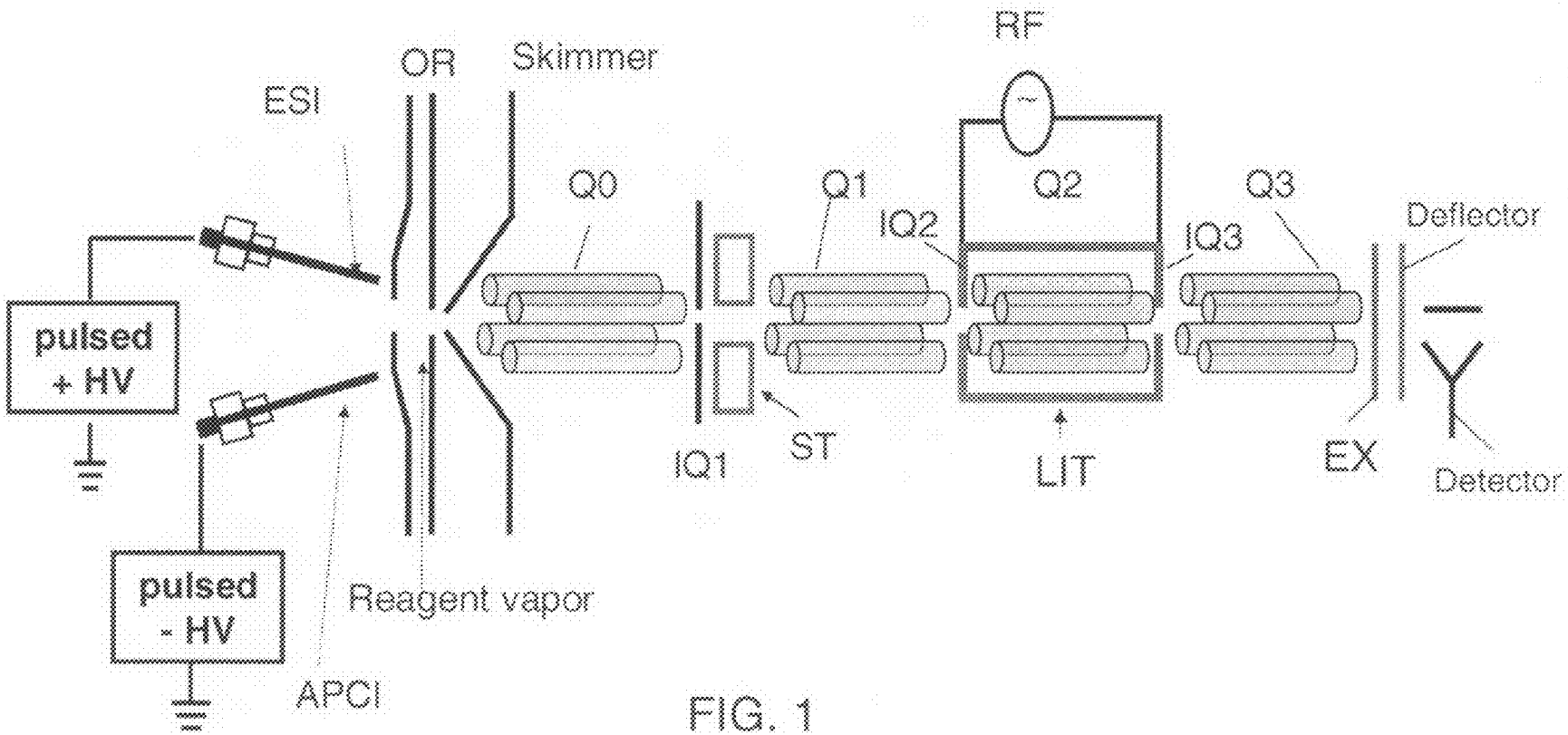
FIG. 1 shows a schematic diagram of a QTRAP hybrid triple quadrupole/linear ion trap instrument as modified for ion/ion reaction studies.

FIG. 1 shows an example of an apparatus for performing the method, which is a modified prototype version of Q TRAP mass spectrometer (Applied Biosystems/MDS SCIEX, Concord, Ontario, Canada). Two ion sources (nano-electrospray (ESI) source and an APCI (atmospheric pressure chemical ionization) source) were disposed at one end of the device, so as to inject ionized cations or anions of various species into the device. The ions may be singly or multiply charged, and the sense of the charge may be the same or different for the two ion sources.

The Q TRAP electronics were modified to superimpose auxiliary RF signals on the containment lenses IQ2 and IQ3 of the Q2 quadrupole array, which allowed the mutual storage of oppositely charged ions in the Q2 cell. The frequency and amplitude of the auxiliary RF signals applied to the containment lenses IQ2 and IQ3 of the Q2 quadrupole array were optimized for the electron transfer ion/ion reaction experiments. The Q TRAP operated at a drive RF frequency of 650 kHz.

The ion path was based on that of a triple-quadrupole mass spectrometer with the last quadrupole rod array (Q3) configured to operate either as a conventional RF/DC mass filter or as a linear ion trap (LIT) with mass-selective axial ejection (MSAE).

The ions from the sources travel through a curtain gas and differential pumping regions (OR, SK) into a quadrupole ion guide (Q0). The Q0 chamber and the analyzer chamber were separated by a differential pumping aperture IQ1. The analyzer chamber contained three round-rod quadrupole arrays in series: viz., an analyzing quadrupole Q1, a collision-cell quadrupole (Q2), and an analyzing quadrupole (Q3). Each of the quadrupoles was 127 mm in length with a field radius of 4.17 mm. A short RF-only Brubaker lens (ST), located in front of the Q1 quadrupole, was capacitively coupled to the Q1 drive RF power supply.

The Q TRAP electronics were modified to superimpose auxiliary RF signals on the containment lenses IQ2 and IQ3 of the Q2 quadrupole array, which allowed mutual storage of oppositely charged ions in the Q2 cell acting as a linear ion trap (LIT). The frequency and amplitude of the auxiliary RF signals applied to the containment lenses IQ2 and IQ3 of the Q2 quadrupole array were optimized for the electron transfer ion/ion reaction experiments.

The Q3 quadrupole was constructed from round gold-coated ceramic rods. Downstream of Q3 there were two additional lenses, the first with a mesh-covered 8-mm-diameter aperture, and the second with an open 8-mm aperture. These lenses are referred to as the "exit lens" (EX) and "deflector", respectively. Generally, the deflector was held at about 200 V more attractive with respect to the exit lens in order to extract ions from the Q3 LIT toward the ion detector, an ETP (Sydney, Australia) discrete dynode electron multiplier. The detector was operated in pulse counting mode with the entrance floated to −6 kV for positive ion detection and +4 kV for negative ion detection. An auxiliary RF voltage applied to Q3 was ramped in proportion to mass/charge (m/z) during the analytical scans. The ions trapped within the Q3 LIT were resonantly excited by a 380-kHz signal and mass-selectively ejected axially.

The pulsed dual ionization source was coupled directly to the interface of the QTRAP mass spectrometer, and included a nano-electrostatic-ion (ESI) emitter for the generation of multiply charged peptide cations, and an atmosphere pressure chemical ionization (APCI) needle for the formation of radical anions derived from azobenzene. Sequential pulsing and accumulation of the oppositely charged ions were under the control of the Daetalyst 3.6 software, provided by MDS SCIEX.

The materials used in an experimental example of the method were methanol and glacial acetic acid (Mallinckrodt, Phillipsburg, N.J.); and peptides KGAILKGAILR, LLLLKLLLK and LIAGDGAILR were synthesized from SynPep (Dublin, Calif.). Solutions of peptides were diluted to 20 μM in 50/50/1 (v/v/v) methanol/water/acetic acid for positive nano-electrospray (nano-ESI). Azobenzene was obtained from Sigma-Aldrich (St. Louis, Mo.). The materials were used without further purification.

An example of performing the method using the apparatus of FIG. 1 for electron transfer ion/ion reactions includes: (1) pulsing the high voltage (−3 kV) applied on the APCI needle and injection of azobenzene radical anions into the Q2 linear ion trap (LIT), selected by Q1 in mass-resolving mode; (2) switching off the high voltage on the APCI needle while the anions are kinetically cooled in Q2 for about 150 ms; (3) switching on the high voltage (+1.0-1.5 kV) on the nano-ESI emitter and injection of positive ions selected by Q1 in mass-resolving mode into the Q2 LIT with relatively low kinetic energies; (4) mutual storage of oppositely charged ions in Q2 LIT; (5) ejecting the surviving anions from Q2 by applying attractive DC potentials to the Q2 containment lenses; (6) transfer of the ETD product ions from Q2 into Q3 for about 50 ms, with a variable potential differences between Q2 and Q3 rods; (7) kinetically cooling the transferred ions for about 50 ms in Q3; and, (8) mass analysis of ions in Q3 by mass selective axial ejection (MSEA) using a supplementary RF signal at a frequency of about 380 kHz. A process variable for this example was the Q2/Q3 voltage offset difference in step (6). The resultant spectra were typically the averages of 20-100 individual scans.

The method described results in the collisional activation of ions upon transfer from Q2 into Q3 of the apparatus. The collisional activation of ions occurs upon transfer from the relatively high pressure environment of Q2 into the lower pressure environment of Q3, which is operated in the ion trapping mode. Here, Q3 is operated throughout the transfer process so as to collect as wide a range of product ions as possible, rather than initial operation of Q3 at an RF amplitude level sufficiently high to avoid collection of dissociation products lower in mass-to-charge ratio than that of the precursor ion of interest. Operation of Q3 in the latter mode may introduce a delay period before collection of dissociation products, such that fragments from relatively long-lived precursor ions are sampled. In the method described herein, substantially all ETD products formed initially in Q2 are transferred to Q3, while subjecting the ions to relatively mild collisional activation in the transfer process. In this way, relatively fragile species, such as survivor ions from electron transfer, may be induced to fragment while the fragmentation of proton transfer products, as well as of first generation electron transfer dissociation products, may be minimized.

The extent of ETD may be much lower for doubly-protonated peptides with about 10-20 residues than for triply-charged versions of the same peptide. Such peptide ions, therefore, are candidates for application of a post-ion/ion reaction collisional-activation step.

Figure 2:
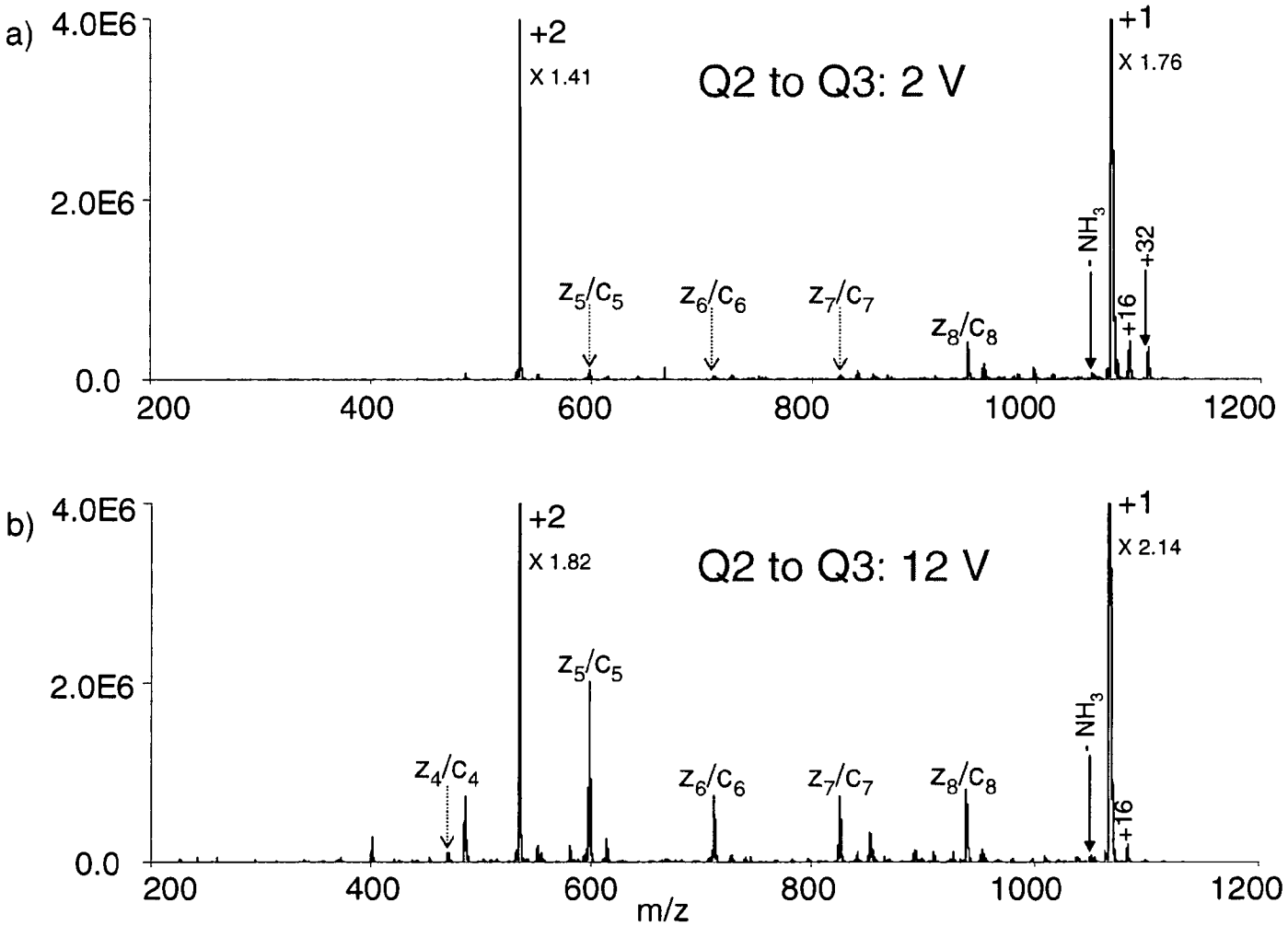
FIG. 2 illustrates spectra derived from the reaction of doubly-protonated LLLLKLLLK with azobenzene anions of Q2 after transfer to Q3 with a Q2/Q3 voltage difference of a) 2 V and b) 12 V.

FIG. 2 shows experimental data of effect of collisional activation of ions present in Q2 after the reaction of doubly-protonated LLLLKLLLK with azobenzene radical anions upon transfer from Q2 to Q3. FIG. 2*a* shows the result after transfer of ions in which the DC offset between Q2 and Q3 was 2 V, a condition in which minimal acceleration occurs during the transfer between the two linear ion traps. FIG. 2*b* shows the experimental results obtained when the ions were transferred with a voltage difference of 12 V. For this particular peptide, the $z_n$ and $c_n$ ions cannot be distinguished by mass measurement. Nevertheless, one may conclude that transfer from Q2 to Q3 at the 12 V potential difference gives rise to a significantly larger contribution from the informative ETD fragments than the data collected with a 2 V potential difference between Q2 and Q3. A measure of the yield of dissociation products due to the electron transfer reaction is provided by % ETD, which may be defined as:

$$\%\,ETD \equiv \frac{\sum c,\ z,\ \text{neutral}\cdot\text{losses}}{\sum\ \text{post}\cdot Ion/Ion\cdot\text{products}\cdot(\text{residual}\cdot 2^{+}\cdot\text{excluded})}\times 100$$

for doubly-protonated species. By excluding the signal due to unreacted doubly-protonated peptides, the % ETD term indicates the percentage of reacting peptide species that give rise to electron transfer fragments. For the data of FIG. 2*a*, % ETD is 12.3%, whereas for FIG. 2*b*, % ETD is 36.0%.

The improvement in % ETD for a particular polypeptide reactant depends upon the extent to which ET survivors are formed, and the efficiency with which the survivors can be dissociated. The % ETD may be increased both by the selection of the anionic reagent and by the selection of conditions for subsequent activation of the survivors.

Figure 3:
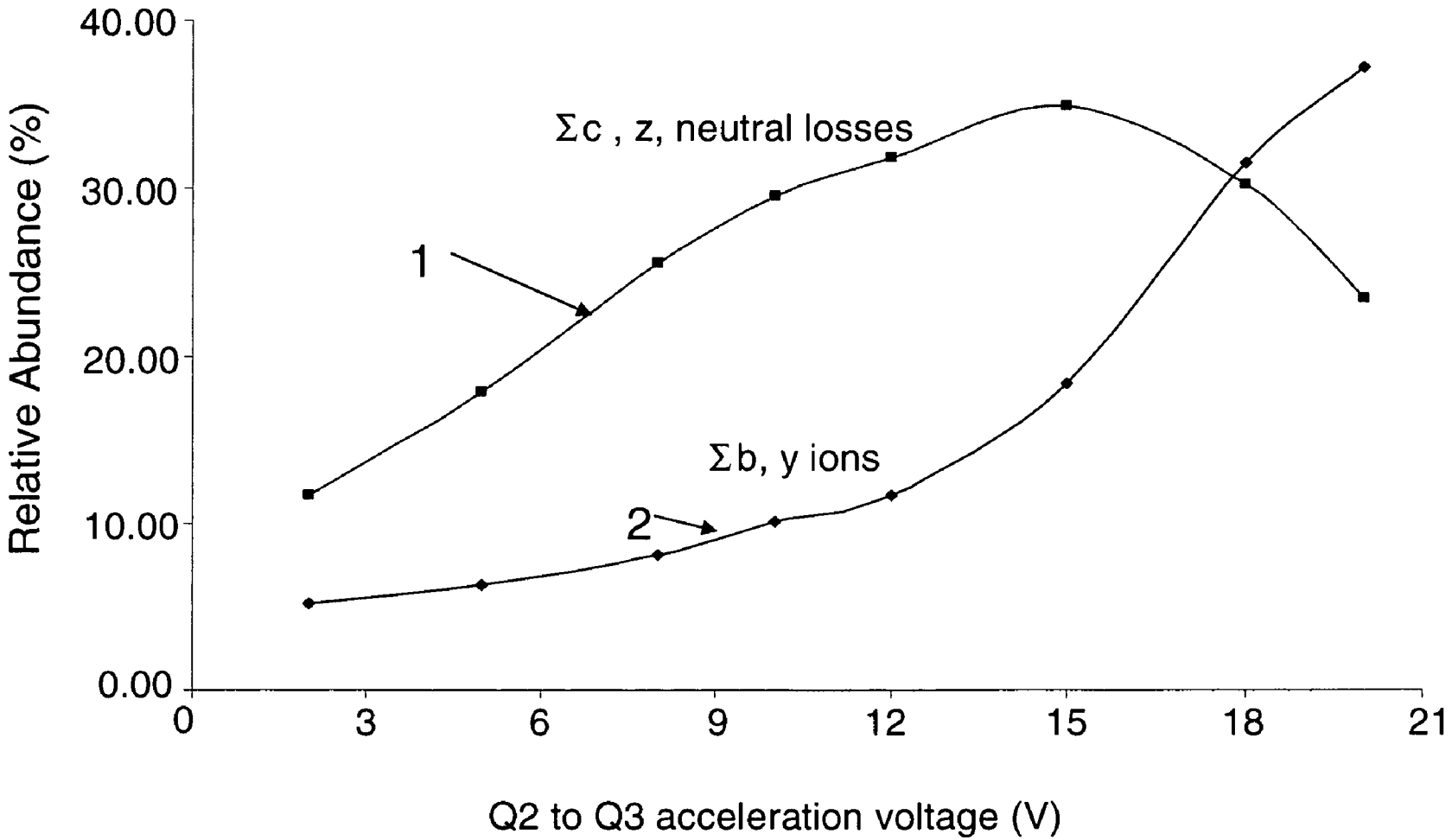
FIG. 3 shows the sum of the relative abundances of the fragments that result from electron transfer and those that arise from collisional activation of polypeptide ions as a function of the voltage offset difference between Q2 and Q3; and, FIG. 4 shows the relative abundances of electron transfer products as a function of peptide sequence for the reaction of doubly-protonated LIAGDGAILR with azobenzene anions at four different Q2/Q3 transfer voltages.

Dissociation of proton transfer product ions and undissociated polypeptide precursor ions may be reduced so as to simplify the data interpretation. FIG. 3 shows the effect of the voltage difference between Q2 and Q3 on the sum of the relative abundances of the fragments that arise from both direct ETD and dissociation of electron transfer survivors (Curve 1) and the sum of products that arise from dissociation of even-electron polypeptide ions (Curve 2). A measure of the relative abundances of fragments may be defined as follows:

$$\text{relative}\cdot\text{abundance}\left(\sum c,\ z,\ \text{neutral}\cdot\text{losses}\right) = \frac{\sum c,\ z,\ \text{neutral}\cdot\text{losses}}{\sum c,\ z,\ \text{neutral}\cdot\text{losses},\ \text{residual}\cdot 1^{+},\ b,\ y}\times 100$$

$$\text{relative}\cdot\text{abundance}\left(\sum b,\ y,\right) = \frac{\sum b,\ y}{\sum c,\ z,\ \text{neutral}\cdot\text{losses},\ \text{residual}\cdot 1^{+},\ b,\ y}\times 100$$

These products may arise from collisional activation of the precursor ion upon injection into Q2 from Q1 as well as from the dissociation of residual reactant ions and the proton transfer product upon transfer from Q2 to Q3.

The data collected at voltage difference of 2 V represents a condition in which almost all of the fragment ions may have been formed in Q2 prior to transfer into Q3. As the voltage difference increases, the changes in fragment ion abundances may be due to dissociation resulting from the Q2 to Q3 transfer process. The results suggest a factor of approximately three increase in the yields of electron transfer dissociation products over the Q2/Q3 voltage difference range (2-12 V). The shape of the b-and y-type fragment curve (Curve 2) differs from that of the electron transfer fragment curve (Curve 1) as the value increases more slowly up until approximately 12 V, and then increases relatively rapidly at high voltage differences. This may be consistent with the stabilities of the electron transfer survivors being lower than those of the proton transfer products and may allow for the establishment of a voltage difference that may preferentially sample electron transfer survivors. At the highest difference voltages in the present experiments, the contribution from first generation electron transfer fragments may decrease, which may arise from further dissociation of the first generation fragments.

Figure 4:
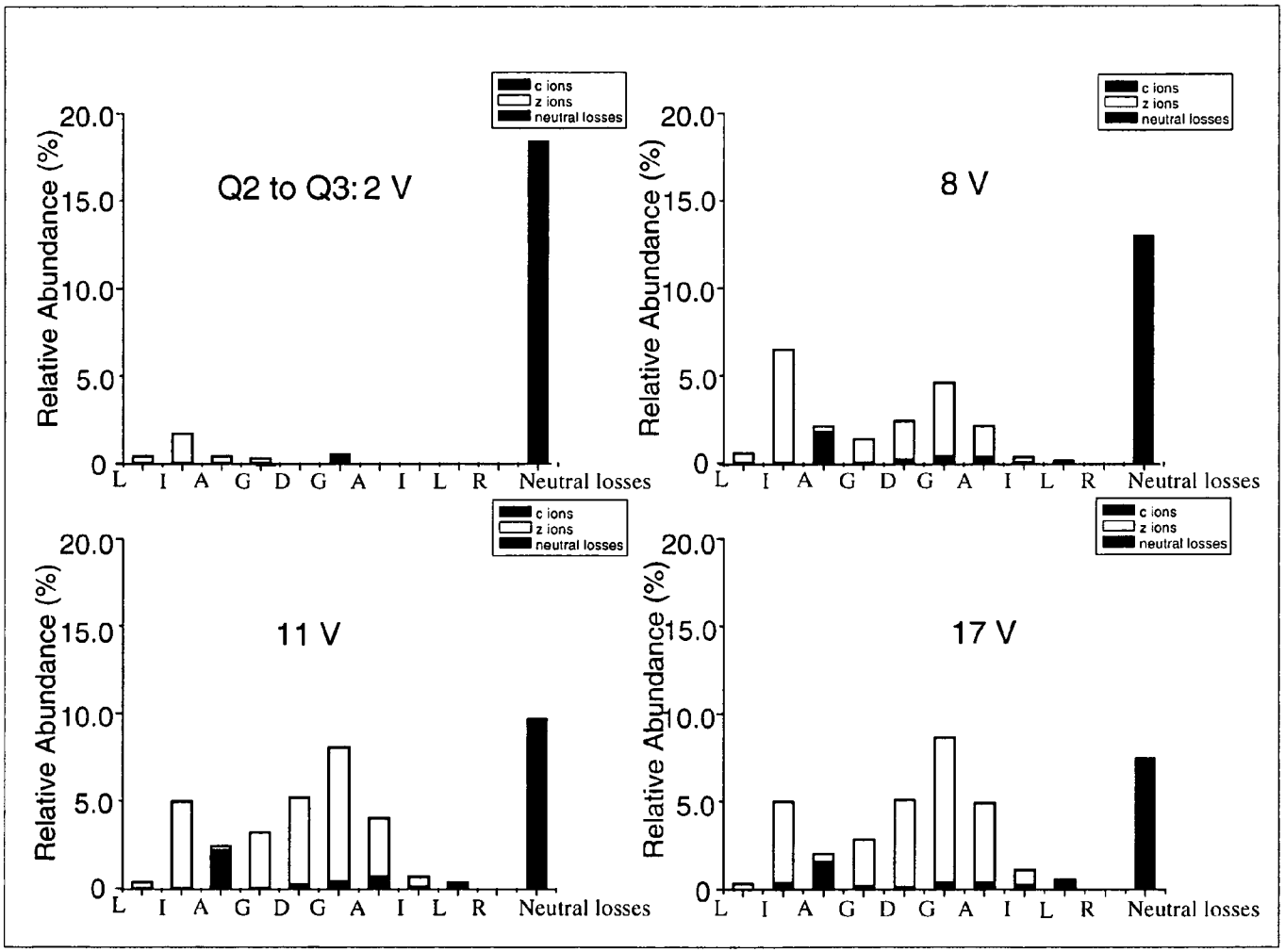

Ion-trap collision-induced dissociation of electron transfer survivor ions may yield some products from cleavages of amide bonds that may not be the same as those observed for direct ETD. Similar observations have been made with the method for collisional activation of the survivor ions, as illustrated in FIG. 4, which summarizes the electron transfer dissociation products of doubly-protonated LIAGDGAILR as a function of the peptide sequence on the x-axis, and includes an entry for neutral loss products. The sequence informative ions that are formed directly, as reflected in the data collected with a transfer voltage of 2 V, arise from five of the nine amide linkages in the peptide, whereas at the higher transfer voltages, evidence for cleavage at all nine amide linkages may be apparent. Hence, the increase in % ETD may be associated with the activation of the electron transfer survivors and may also be accompanied by an increase in the amount of structural information.

The acceleration of ions from one linear ion trap to another in the presence of a background gas at roughly 1 mtorr may be used to effect collision-induced dissociation. The extent of collision-induced dissociation of species with different stabilities may be controlled. For example, the voltage difference between the two ion traps can be adjusted to maximize dissociation of electron transfer survivor ions while minimizing collision-induced dissociation of proton transfer and residual precursor ions. The use of this method increases the % ETD and extent of structural information from polypeptide ions that tend to yield a significant population of electron transfer survivor ions. The method does not require extensive tuning and the acceleration may not be significantly dependent upon the mass-to-charge ratios of the ions. The method also does not require careful matching of a resonance excitation frequency to the ions of interest when compared to ion trap collisional activation.

This method may be used, for example, in proteomics, where protein identification and characterization is accomplished by dissociation of peptide or protein ions. The method results in activating surviving electron transfer products without heating the vacuum system.

Although only a few examples of this invention have been described in detail above, those skilled in the art will readily appreciate that many modifications are possible without materially departing from the novel teachings and advantages of the invention. Accordingly, all such modifications are intended to be included within the scope of this invention as defined in the following claims.

What is claimed is:

1. A method of mass spectrometry, the method comprising:

creating a first ion trapping volume within a chamber of a first ion trap;

injecting a first population of ions into the first ion trapping volume so that the first population is axially trapped stored in the first ion trapping volume; kinetically cooling the first ion population;

subsequently, injecting a second population of charged ions into the first ion trapping volume such that a physical overlap of the first and the second ion populations occurs;

creating a second ion trapping volume within a chamber of a second ion trap;

ejecting ions from the first ion trap into the second ion trap; and performing mass spectrometry on the ions of the second ion trap.

2. The method of claim 1, wherein the mass spectrometry is performed by operating the second ion trap in a mass-selective axial ejection (MSAE) mode.

3. The method of claim 1, wherein the ejecting is performed by applying a DC voltage between a component of the first ion trap and a component of the second ion trap.

4. The method of claim 3, wherein the DC voltage is selectable, and the mass spectrometry data are obtained at at least two voltage values.

5. The method of claim 1, wherein at least one of the first ion population or second ion population is produced by an electrostatic ionization (ESI) device.

6. The method of claim 1, wherein at least one of the first ion population or second ion population is produced by an atmosphere pressure chemical ionization (APCI) needle.

7. The method of claim 1, wherein the ions in the second trap are kinetically cooled.

8. The method of claim 1, wherein at least one of the first or second ion traps is a linear ion trap (LIT).

9. A method of performing mass spectrometry, the method comprising:

operating a first source of ions;

selecting first ions by a mass filter and injecting the selected first ions into a first volume acting as first linear ion trap (LIT);

switching off the first source and cooling the selected first ions in the first LIT;

operating a second source of ions;

selecting second ions by a mass filter and injecting the selected second ions into the first volume acting as a LIT;

storing the first and second selected ions in the first LIT;

ejecting ions from the first LIT to a second LIT; and, analyzing a mass of the ions of the second LIT.

10. The method of claim 9, wherein the mass is analyzed using mass selective axial ejection (MSAE) from the second trap.

11. The method of claim 9, wherein the first ions are kinetically cooled in the first trap.

12. The method of claim 9, wherein the ions in the second trap are kinetically cooled.

13. The method of claim 9, where the step of ejecting is performed by applying a voltage between a structure of the first trap and a structure of the second trap.

14. The method of claim 13, where the structures a rod of a quadrupole array.

15. The method of claim 13, wherein the voltage is a parameter in the mass analysis.

16. The method of claim 9, wherein the first ions are anions and the second ions are cations.

17. An apparatus for analyzing molecules, the apparatus comprising:

a first linear ion trap (LIT), configured to:

accept, store and kinetically cool a first population of ions;

accept and store a second population of ions;

a second linear ion trap (LIT), configured to:

accept ions ejected from the first LIT by application of a voltage between the first and the second LITs, and kinetically cool the accepted ions; and a mass analyzer.

18. The apparatus of claim 17, wherein a mass of the ions in the second LIT is measured with a first DC voltage value applied, and the mass of the ions is measured with a second DC voltage value applied.

19. The apparatus of claim 17, wherein at least one of the first populations of ions and the second populations of ions is supplied by one of an electrostatic ionization (ESI) device or a atmosphere pressure chemical ionization (APCI) needle.

20. The apparatus of claim 17, wherein the mass analyzed uses the second LIT as a mass selective axial emitter (MSAE).

* * * * *

UNITED STATES PATENT AND TRADEMARK OFFICE

CERTIFICATE OF CORRECTION

PATENT NO. : 7,829,851 B2
APPLICATION NO. : 11/998266
DATED : November 9, 2010
INVENTOR(S) : Scott A. McLuckey et al.

It is certified that error appears in the above-identified patent and that said Letters Patent is hereby corrected as shown below:

Column 7, claim 1, line 24, before "in the first ion trapping" delete "stored".

Signed and Sealed this
Twenty-fifth Day of January, 2011

David J. Kappos

David J. Kappos
*Director of the United States Patent and Trademark Office*